US006235236B1

(12) United States Patent
Velcich et al.

(10) Patent No.: US 6,235,236 B1
(45) Date of Patent: May 22, 2001

(54) APPARATUS FOR TREATING EMISSIONS OF MANUFACTURING PLANTS

(75) Inventors: Gianfranco Velcich, Udine; Enrico Malfa, Zanica; Francesca Nappini, Monza, all of (IT)

(73) Assignee: ABB Ricerca SpA, Sesto San Giovanni (IT)

( * ) Notice: Subject to any disclaimer, the term of this patent is extended or adjusted under 35 U.S.C. 154(b) by 0 days.

(21) Appl. No.: 09/418,971

(22) Filed: Oct. 14, 1999

(30) Foreign Application Priority Data

Oct. 16, 1998 (IT) ..... MI98A2228

(51) Int. Cl.[7] ..... C21B 7/22
(52) U.S. Cl. ..... 266/155; 266/144
(58) Field of Search ..... 266/144, 155, 266/156, 159, 157

(56) References Cited

U.S. PATENT DOCUMENTS

| | | | | |
|---|---|---|---|---|
| 3,726,065 | * | 4/1973 | Hausberg et al. | 55/223 |
| 4,000,885 | * | 1/1977 | VanDrill | 266/155 |
| 4,202,280 | | 5/1980 | Bereiter et al. . | |

FOREIGN PATENT DOCUMENTS

| | | | |
|---|---|---|---|
| 0 177 667 | | 4/1986 | (EP) . |
| 0 748 647 | | 12/1996 | (EP) . |
| 0994319 A2 | * | 4/2000 | (EP) . |
| 2 170 749 | | 9/1973 | (FR) . |

* cited by examiner

*Primary Examiner*—Scott Kastler
(74) *Attorney, Agent, or Firm*—Oblon, Spivak, McClelland, Maier & Neustadt, P.C.

(57) ABSTRACT

An emission treatment apparatus for manufacturing plants including an inlet duct, a decantation chamber and an outlet duct. The emission treatment apparatus advantageously includes elements located inside of the decantation chamber for rendering uniform the flow of the emissions.

13 Claims, 3 Drawing Sheets

APPARATUS FOR TREATING EMISSIONS OF MANUFACTURING PLANTS

BACKGROUND OF THE INVENTION

1. Field of the Invention

The present invention relates to an apparatus for treating emissions of manufacturing plants having particular characteristics and structure. The invention is particularly well adapted for use in steel-plants with electric arc furnaces. For illustrative purposes the invention is described below with respect to its use in steel-plants, however, this invention is not intended to be limited solely to the use with steel-plants.

2. Discussion of the Background

A known example of an apparatus for treating the emissions of a steel-plants is described below with reference to the schematic diagram depicted in FIG. 1. A conventional example of a steel-plant emission treatment system includes an emission stream 2 that exist a furnace (not depicted) and accesses a treatment apparatus 1 through an elliptical duct 3. At the top of the duct 3 there is a movable flange 4 which adjusts the inflow of air (indicated by the arrow 10) into the duct 3. The injection of the air stream 10 produces a first cooling of the stream 2. Downstream of the movable flange 4, the duct 3 widens in order to take into account the greater volume of the conveyed fluid. The duct 3 conveys the mixture of emissions and air (designated by the arrow 5) toward a decantation chamber 6. During travel along the duct 3, the mixture 5 undergoes further cooling by convective exchange with the walls of the duct 3. The decantation chamber 6 separates the metallic particles (cooled molten drops) entrained by the emissions in the duct 3. In general, the walls of the decantation chamber are made of refractory cement to ensure adequate thermal insulation.

From the decantation chamber 6, the mixture 5 accesses a vertical duct 7 and then a divergent outlet duct 8. At the outlet of the decantation chamber, the air and gas mixture 5 is subjected to an injection of nebulized water by means of an array of nozzles 9. This injection of water, together with the path along the vertical duct 7, cools the mixture 5 before it is fed to the subsequent filtration stage (not depicted) and then into the atmosphere. FIG. 2 is a side view of the vertical duct 7. Duct 7 has a rectangular cross-section in its upper part, whereas its lower part has a hopper-like tapering region 11 on two sides.

Conventional apparatuses for treating the emissions of steel-plants suffer from a problem where the cooling of the emissions at the outlet is insufficient due to the non-uniform flow of the emissions. This problem is even more severe if the size of the steel-plants need to be compact.

The path of the emissions through a conventional emission treatment apparatus is depicted schematically in FIG. 3. The inlet emissions 2 are mixed with an air stream 10. The gas mixture 5 reaches the decantation chamber, where vortical structures (represented schematically by the arrows 15 and 16) are generated. Part of the mixture 5 directly accesses the vertical duct 7, while the remainder continues to recirculate in the decantation chamber due to the vortices generated inside the decantation chamber. Due to the presence of the vortical structures 15 and 16, vortical structures (represented schematically by arrows 18 and 19) are generated proximate to the array of injection nozzles 9. The presence of the vortices produces severe non-uniformity in the field of motion of the mixture in the region where the nozzles are installed. This non-uniformity causes malfunctions of the nozzles and therefore inadequate cooling of the mixture that accesses the outlet duct 8. The increase in the temperature of the gases leaving the duct 8 can damage the filtration stages (not depicted) located downstream, thereby reducing their reliability and their residual life.

Other conventional alternative embodiments solve the problem of the uniformity of the stream of emissions inside the emission treatment apparatus by increasing the dimensions of the inlet and outlet ducts. However, this solution is expensive and would make the plant scarcely competitive from the economic point of view. Moreover, these solutions, due to their considerable dimensions, can seldom be adopted because they considerably increase the area occupied by the steel-plants, with a considerable increase in its operating costs.

SUMMARY OF THE INVENTION

An object of the present invention is to provide an apparatus for treating manufacturing plant emissions that has a structure and geometry of reduced dimensions that ensures adequate cooling of the emissions.

The present invention achieves this objective by ensuring uniform motion of the emissions inside an outlet duct of the emission treatment apparatus.

Another object of the present invention is to provide an emission treatment apparatus that is highly reliable and relatively easy to maintain.

A further object of the present invention is to provide an emission treatment apparatus that is relatively easy to provide and at a relatively low cost.

Thus the present invention provides an emission treatment apparatus that includes an inlet duct, a decantation chamber and an outlet duct. The present invention is characterized in that it includes a structure for rendering uniform the flow of the emissions inside the decantation chamber.

BRIEF DESCRIPTION OF THE DRAWINGS

Further characteristics and advantages of the present invention will become apparent from the following detailed description of preferred but not exclusive embodiments of an emission treatment apparatus illustrated only by way of non-limitative example in the accompanying drawings, wherein.

DESCRIPTION OF THE PREFERRED EMBODIMENTS

A preferred but not exclusive embodiment of an emission treatment apparatus according to the invention is described with reference to FIG. 4.

Figure 2:
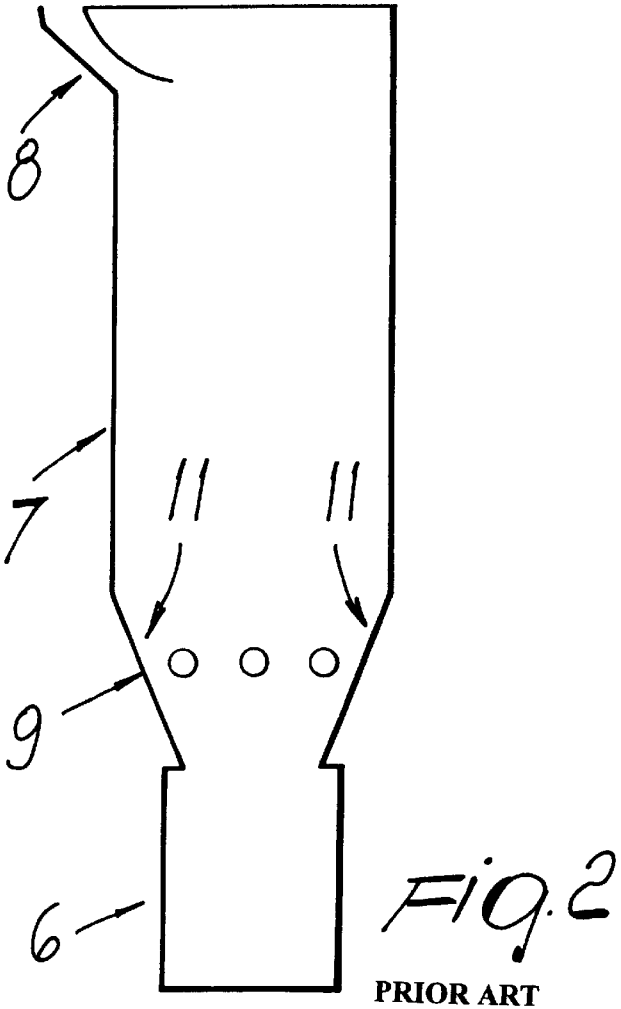
Fig. 2 PRIOR ART
FIG. 2 is a rear schematic view of the conventional embodiment of the emission treatment apparatus depicted in FIG. 1.
Figure 1:
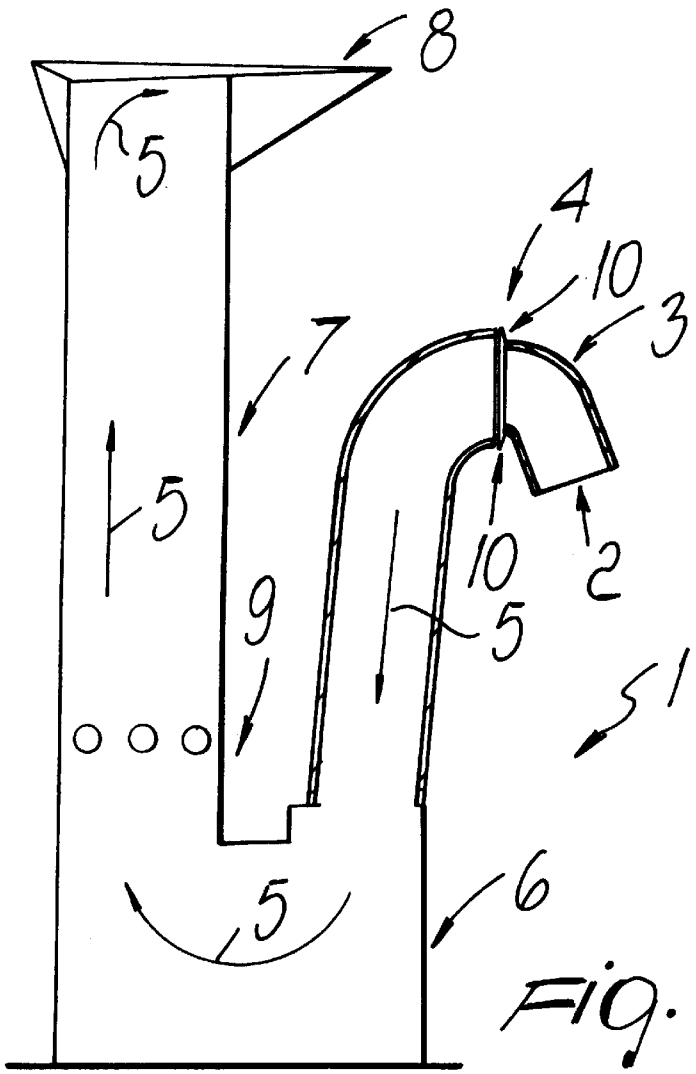
Fig. 1 PRIOR ART
FIG. 1 is a side schematic view of a conventional embodiment of an emission treatment apparatus.
Figure 4:
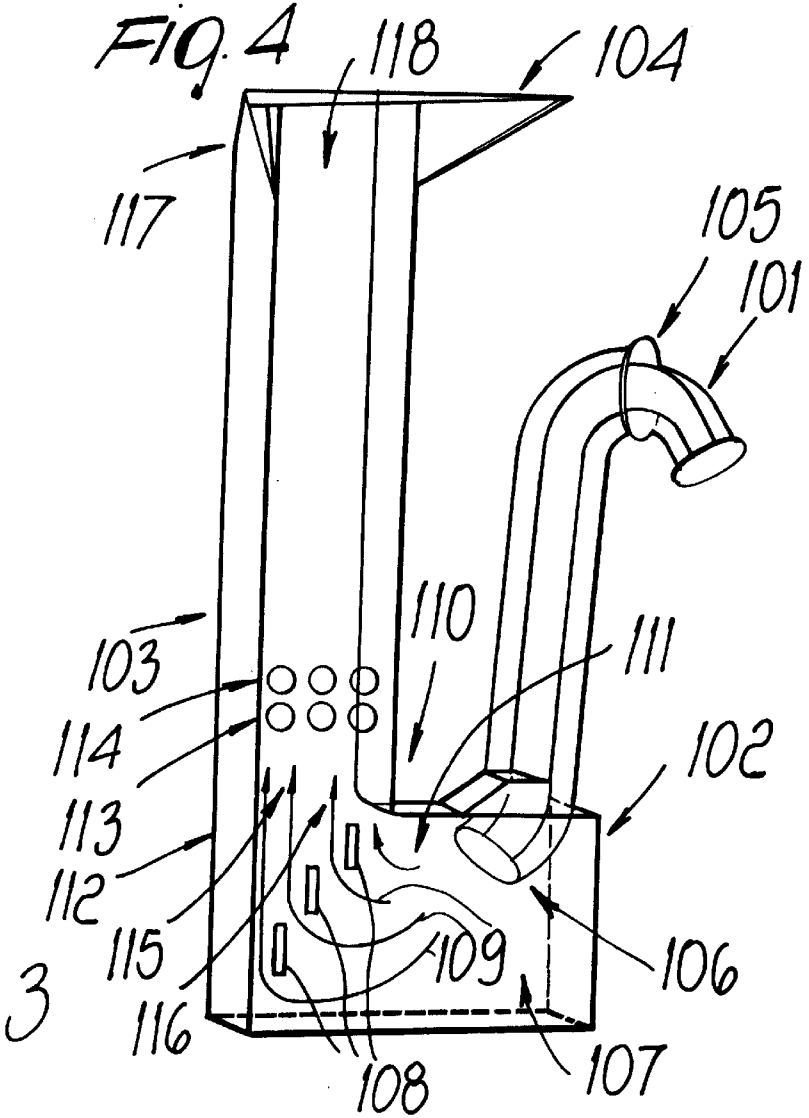
FIG. 4 is a perspective view of a preferred but not exclusive embodiment of an emission treatment apparatus according to the invention.
Figure 3:
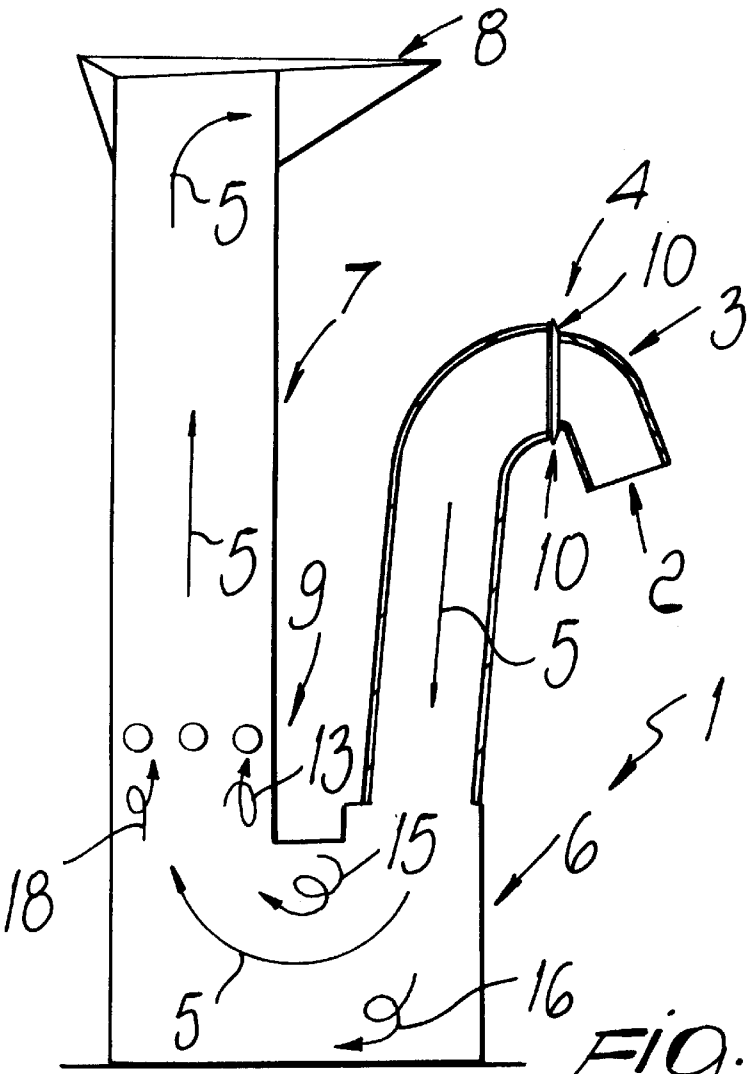
FIG. 3 PRIOR ART
FIG. 3 is a side schematic view of the motion of the emissions inside a conventional embodiment of an emission treatment apparatus.

The apparatus of FIG. 4 includes an inlet duct 101, a decantation chamber 102 and a vertical duct 103, at the top end of which there is a diverging outlet duct 104. The inlet duct 101 has a flange 105 for injecting an air stream.

The decantation chamber 102 contains means for rendering uniform the flow of the emissions. It has in fact been observed that the presence of the means for rendering uniform the emission flow avoids the generation of vortical structures inside the decantation chamber and the outlet duct, allowing adequate cooling of the emissions without increasing their dimensions. In the embodiment depicted in FIG. 4, the means for rendering uniform the emission flow includes a plurality of baffles 108 that are preferably equidistant and mutually staggered. The baffles 108 can be made of refractory material or, according to a preferred embodiment, can be constructed of two metal plates between which an interspace is interposed that is filled by a coolant liquid. The baffles 108 split the flow of the emissions as indicated by the arrows 109 and ensure its uniformity.

Figure 5:
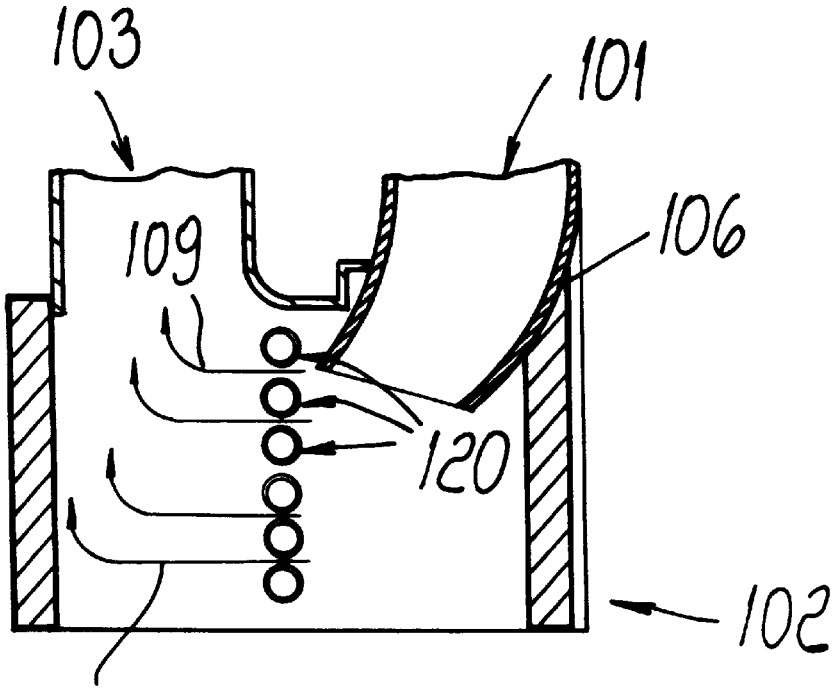
FIG. 5 is a view of a constructive detail of a preferred but not exclusive embodiment of an emission treatment apparatus according to the invention.

In an alternative embodiment depicted in FIG. 5, the means for rendering uniform the flow of the emissions includes one or more arrays 120 of pipes inserted in the decantation chamber 102 and appropriately cooled by recirculating a coolant liquid inside them. In particular, FIG. 5 depicts a preferred embodiment in which a single array of pipes is used. This solution advantageously renders uniform the flow of the emissions 109. Moreover, in practice, it has been observed that the load losses due to the presence of the array of pipes inside the decantation chamber are negligible.

Figure 6:
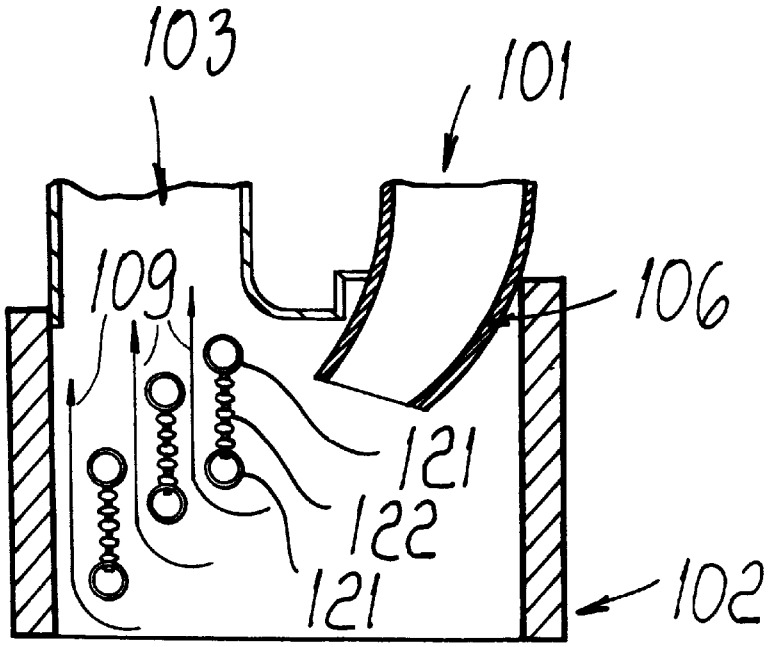
FIG. 6 is a view of another constructive detail of a preferred but not exclusive embodiment of an emission treatment apparatus according to the invention.

FIG. 6 illustrates another alternative embodiment in which chains 122, supported by pairs of appropriately cooled pipes 121, are placed inside the decantation chamber 102 as means for rendering uniform the flow of the emissions. The chains are advantageously arranged at right angles to the main axis of the pairs of pipes 121. Each chain can alternatively be covered by metallic cylindrical enclosures in order to avoid the deposition of slag thereon. Advantageously, this solution is very cheap and easy to install. Like the previously described solutions, the presence of the chains in the decantation chamber renders the flow 109 more uniform before reaching the duct 103. As in the previously described embodiment, in practice it has been observed that the load losses are negligible in the embodiment depicted in FIG. 6.

Advantageously, the duct 103 is connected to the back wall of the decantation chamber 102 with a direct connection 112 (see FIG. 4) which has an appropriate angle (preferably not a perpendicular angle) with respect to the plane of the decantation chamber and is blended with the upper part of the decantation chamber by means of a blending portion 110 which has an appropriate shape in order to contribute to the uniformity of the flow. Preferably, the blending portion 110 is arc-shaped. This solution is advantageous in that, together with the presence of means for rendering uniform the flow in the decantation chamber, it avoids the formation of vortices in the regions designated by the arrows 111, 115, and 116.

The nozzles for injecting nebulized cooling water are arranged inside the duct 103. Preferably, the duct 103 has two arrays of nozzles 113 and 114 located on different planes. In this manner, the flow of the emissions is subjected to two injection processes and is therefore insipidly cooled. According to alternative embodiments of the invention, there can be a plurality of arrays of nozzles arranged on different planes.

According to a preferred embodiment, the duct 103 has a blending portion 117 in an end part. Advantageously, the blending portion 117 has an arc-shaped profile which ensures that the outflow of the emissions is toward the divergent outlet duct 104 and avoids the onset of vortices in the end region 118, thereby reducing load losses.

Preferably, the duct 101 enters the decantation chamber 102 by an extent 106 which is directed so as to convey the emissions appropriately toward the duct 103. This ensures that the emissions are injected centrally with respect to the decantation chamber so as to avoid the onset of vortices in the rear region (indicated by the arrow 107) of the decantation chamber 102.

Numerous modifications and variations of the present invention are possible in light of the above teachings. All of the structural details described above may further be replaced with technically equivalent elements. In practice, the materials and components employed in the above description can be substituted with any other materials and components according to requirements and to the state of the art, so long as they are compatible with the specific use. It is to be understood that within the scope of the appended claims, the present invention can be practiced other than as specifically described herein.

What is claimed is:

1. An emission treatment apparatus for manufacturing plants, comprising:

a decantation chamber;

an inlet duct connected to said decantation chamber;

an outlet duct connected to said decantation chamber; and means located inside of said decantation chamber for rendering uniform a flow of emissions within said decantation chamber, wherein said means for rendering uniform a flow of the emissions includes pairs of pipes inside which a coolant liquid flows, said pairs of pipes being interleaved by chains.

2. The emission treatment apparatus for steel-plants according to claim 1, wherein said chains are arranged at right angles to a main axis of said pipes and are covered by cylindrical metallic enclosures.

3. The emission treatment apparatus for steel-plants according to claim 1, wherein said outlet duct includes at least one array of injection nozzles located on different planes.

4. The emission treatment apparatus for steel-plants according to claim 1, wherein said outlet duct is blended with an upper part of said decantation chamber by a blending portion whose shape is configured to facilitate uniformity of emission flow.

5. The emission treatment apparatus for steel-plants according to claim 4, wherein said blending portion has an arc-shaped profile.

6. The emission treatment apparatus for steel-plants according to claim 1, wherein said outlet duct is blended with a diverging outlet duct by a blending portion which is configured to facilitate uniformity of emission flow.

7. The emission treatment apparatus for steel-plants according to claim 5, wherein said blending portion has an arc-shaped profile.

8. The emission treatment apparatus for steel-plants according to claim 1, wherein said outlet duct is connected to a back wall of said decantation chamber with a direct connection which is angled with respect to a plane of said decantation chamber.

9. The emission treatment apparatus for steel-plants according to claim 1, wherein said inlet duct partly enters said decantation chamber.

10. A steel-plant comprising an emission treatment apparatus according to claim 1.

11. An emission treatment apparatus for manufacturing plants, comprising:

a decantation chamber;

an inlet duct configured to communicate with said decantation chamber;

an outlet duct configured to communicate with said decantation chamber; and at least one fluid flow modifying implement provided within said decantation chamber and configured to provide for a uniform flow of emissions traveling within said decantation chamber from said inlet duct to said outlet duct, wherein said at least one fluid flow modifying implement includes at least one pair of pipes having a chain extending therebetween.

12. The emission treatment apparatus for steel-plants according to claim 11, wherein said at least one fluid flow modifying implement has coolant liquid flowing in an inside portion thereof.

13. The emission treatment apparatus for steel-plants according to claim 11, wherein said outlet duct includes at least one array of injection nozzles located on more than one plane.

* * * * *